US010934792B2

(12) United States Patent
Shampine

(10) Patent No.: US 10,934,792 B2
(45) Date of Patent: Mar. 2, 2021

(54) POWERED SHEAVE WITH WIRELINE PUSHING CAPABILITY

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/550,554

(22) PCT Filed: Feb. 10, 2016

(86) PCT No.: PCT/US2016/017259
§ 371 (c)(1),
(2) Date: Aug. 11, 2017

(87) PCT Pub. No.: WO2016/130623
PCT Pub. Date: Aug. 18, 2016

(65) Prior Publication Data

US 2018/0038176 A1 Feb. 8, 2018

Related U.S. Application Data

(60) Provisional application No. 62/115,722, filed on Feb. 13, 2015.

(51) Int. Cl.
*E21B 19/22* (2006.01)
*B66D 3/04* (2006.01)
*B66D 3/20* (2006.01)

(52) U.S. Cl.
CPC ..... *E21B 19/22* (2013.01); *B66D 3/04* (2013.01); *B66D 3/20* (2013.01)

(58) Field of Classification Search
CPC ..... E21B 19/22; B66D 3/34; B66D 3/20
See application file for complete search history.

(56) References Cited

U.S. PATENT DOCUMENTS 1,769,999 A * 7/1930 Johnson ..... E02F 3/9237 37/326
3,116,793 A * 1/1964 McStravick ..... E21B 41/00 166/285

(Continued)

FOREIGN PATENT DOCUMENTS

WO 0120129 A2 3/2001
WO 2010064920 A1 6/2010

(Continued)

OTHER PUBLICATIONS

International Search Report and Written Opinion issued in International Patent Appl. No. PCT/US2016/017259 dated Apr. 25, 2016; 25 pages.

(Continued)

*Primary Examiner* — Aaron L Lembo
(74) *Attorney, Agent, or Firm* — Rodney Warfford

(57) ABSTRACT

Methods include deploying a downhole tool into a wellbore with a conveyance apparatus by mounting a tool to a distal end of a spooled conveyance apparatus, routing the conveyance apparatus around a powered sheave assembly, which includes a plurality of grooves disposed on the outer surface of the sheave to accommodate the conveyance apparatus, and providing a power source for applying torque to the powered sheave. The powered sheave assembly then deploys the conveyance apparatus into the wellbore. In some cases a traction device may be disposed between the powered sheave and the wellbore to provide axial force in both directions. The conveyance apparatus is moved through a sealing apparatus, a blowout preventer, and a wellhead, with (Continued)

the powered sheave, after the routing the conveyance apparatus around a powered sheave.

36 Claims, 5 Drawing Sheets

(56) References Cited

U.S. PATENT DOCUMENTS

| | | | | | |
|---|---|---|---|---|---|
| 3,162,253 | A | * | 12/1964 | Curtis | E21B 19/22 173/147 |
| 3,275,300 | A | * | 9/1966 | Delacour | E21B 19/22 254/265 |
| 3,841,407 | A | * | 10/1974 | Bozeman | B65H 51/14 166/384 |
| 4,325,434 | A | | 4/1982 | Roberts | |
| 4,673,035 | A | * | 6/1987 | Gipson | E21B 19/22 166/77.1 |
| 4,940,095 | A | | 7/1990 | Newman | |
| 5,279,364 | A | * | 1/1994 | Jantzen | E21B 19/22 166/77.3 |
| 5,660,235 | A | * | 8/1997 | Sola | E21B 19/22 166/384 |
| 5,839,514 | A | * | 11/1998 | Gipson | E21B 19/22 166/384 |
| 6,050,338 | A | | 4/2000 | Watkins | |
| 6,164,619 | A | | 12/2000 | Van Winkle et al. | |
| 6,192,983 | B1 | | 2/2001 | Neuroth et al. | |
| 6,209,652 | B1 | | 4/2001 | Portman et al. | |
| 6,913,084 | B2 | | 7/2005 | Boyd | |
| 7,552,890 | B1 | * | 6/2009 | Gipson | B65H 51/10 242/564.4 |
| 7,708,058 | B1 | * | 5/2010 | Gipson | E21B 19/22 166/77.2 |
| 7,814,972 | B2 | | 10/2010 | Angman et al. | |
| 8,047,295 | B2 | | 11/2011 | Skeels et al. | |
| 8,146,660 | B2 | | 4/2012 | Irani et al. | |
| 9,080,412 | B2 | | 7/2015 | Wetzel et al. | |
| 2004/0104024 | A1 | | 6/2004 | Kent et al. | |
| 2007/0051512 | A1 | | 3/2007 | Markel et al. | |
| 2007/0137866 | A1 | | 6/2007 | Ravensbergen et al. | |
| 2007/0162235 | A1 | | 7/2007 | Zhan et al. | |
| 2009/0084558 | A1 | | 4/2009 | Bloom | |
| 2009/0260804 | A1 | | 10/2009 | Mydur et al. | |
| 2010/0104372 | A1 | | 4/2010 | Lawson et al. | |
| 2010/0155054 | A1 | | 6/2010 | Innes et al. | |
| 2010/0163243 | A1 | | 7/2010 | Sbordone | |
| 2010/0230112 | A1 | | 9/2010 | Cox et al. | |
| 2011/0267922 | A1 | | 11/2011 | Shampine et al. | |
| 2011/0272148 | A1 | | 11/2011 | Lovell et al. | |
| 2012/0125622 | A1 | | 5/2012 | Melancon et al. | |
| 2013/0341539 | A1 | | 12/2013 | Hughes et al. | |
| 2014/0048256 | A1 | | 2/2014 | Ringgenberg | |
| 2014/0166270 | A1 | | 6/2014 | Varkey et al. | |
| 2014/0231075 | A1 | | 8/2014 | Springett et al. | |
| 2016/0215584 | A1 | | 7/2016 | Tennant | |

FOREIGN PATENT DOCUMENTS

| | | | |
|---|---|---|---|
| WO | 2014074099 | A1 | 5/2014 |
| WO | 2016130612 | A1 | 8/2016 |
| WO | 2016130617 | A1 | 8/2016 |
| WO | 2016130619 | A1 | 8/2016 |

OTHER PUBLICATIONS

International Search Report and Written Opinion issued in International Patent Appl. No. PCT/US2016/017243 dated May 17, 2016; 11 pages.

International Search Report and Written Opinion issued in International Patent Appl. No. PCT/US2016/017256 dated May 3, 2016; 17 pages.

International Search Report and Written Opinion issued in International Patent Appl. No. PCT/US2016/017254 dated May 3, 2016; 14 pages.

International Search Report and Written Opinion issued in International Patent Appl. No. PCT/US2016/017250 dated May 11, 2016; 10 pages.

* cited by examiner

POWERED SHEAVE WITH WIRELINE PUSHING CAPABILITY

RELATED APPLICATION INFORMATION

This Patent Document claims priority under 35 U.S.C. § 120 to U.S. Provisional Application No. 62/115,722 filed Feb. 13, 2015, the disclosure of which is incorporated by reference herein in its entirety.

FIELD

The field to which the disclosure generally relates to wellsite equipment such as oilfield surface equipment, downhole assemblies, coiled tubing (CT) assemblies, slickline and assemblies, and the like, and more specifically, sheaves similar used to run a short section of wire in and out of a wellbore for deployment purposes.

BACKGROUND

This section provides background information to facilitate a better understanding of the various aspects of the disclosure. It should be understood that the statements in this section of this document are to be read in this light, and not as admissions of prior art.

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like.

In spooled conveyance services such as coiled tubing, wireline, and slickline, downhole tools need to be transferred from the reel to inside the well bore. This transfer may be accomplished using a long riser with the conveyance attached to the top of the long riser. In this method, the tools are either pulled into the bottom of this riser, or are assembled into it. The riser is then attached to the well, is pressure tested, and then the tools are run into the well. In an embodiment, an 'easier to run' service is utilized to place the tools in the well, followed by a 'harder to run' service to perform the running in hole. In this embodiment, the downhole tools are provided with an additional part known as a deployment bar. This deployment bar is intended to provide a surface against which the blowout preventers (BOPs) can both grip and seal. In the case where the 'harder to run' service is coiled tubing, wireline or slickline may be used to pre-place the tools in the coiled tubing BOP. The deployment bar used will be selected to have a diameter substantially equal to the coiled tubing diameter. As part of the contingency plans, it must always be possible to close the master valves of the BOP. In order to do this while the downhole tools are hanging in the BOPs, and without opening the well to atmosphere (thereby creating a blowout), the deployment bar must be capable of being sheared by the shear ram in the BOP. Once this is done, the slip and pipe rams can be opened and the tool dropped into the well.

Having two services involved adds cost to the service, while using almost none of the capabilities of the lighter service. A further challenge comes when the wellhead pressure is significant and the tools are light. In such a situation, the wellhead pressure times the area of the conveyance plus the friction in the sealing system may be larger than the weight of the tool. In this case the wireline or slickline will be unable to move the tools into the well without adding additional weight in the form of sinker bars. Sinker bars add additional tool and riser length without any job function beyond the initial deployment. In general, slickline suffers less from this issue due to the small size of the conveyance. However, this comes with the drawback that the lifting capability of slickline is correspondingly limited. Wireline has much more pulling capacity, but equivalently larger weights required.

It remains desirable to provide improvements in oilfield surface equipment and/or downhole assemblies such as, but not limited to, methods and/or systems for deploying tools into wellbores without the use of sinker bars or the like.

SUMMARY

This section provides a general summary of the disclosure, and is not a necessarily a comprehensive disclosure of its full scope or all of its features.

Some method embodiments according to the disclosure are useful for deploying a downhole tool into a wellbore with a conveyance apparatus by mounting a tool to a distal end of a spooled conveyance apparatus, routing the conveyance apparatus around a powered sheave assembly, which includes a plurality of grooves disposed on the outer surface of the sheave to accommodate the conveyance apparatus, and providing a power source for applying torque to the powered sheave. The powered sheave assembly then deploys the conveyance apparatus into the wellbore. In some cases the tool is connected to a deployment bar disposed between the conveyance apparatus and tool. Also, a traction device may be disposed between the powered sheave and the wellbore to provide axial force in both directions. In some cases, the powered sheave includes gripping means which assist in application of force upon the conveyance apparatus to overcome pressure and friction resistance forces present in the equipment and wellbore. The conveyance apparatus is introduced through a sealing apparatus, a blowout preventer, and a wellhead, after the routing the conveyance apparatus around a powered sheave, in some aspects.

In some aspects, the powered sheave assembly is attached to a pivotable mount and driven by a drive mechanism. A chain for driving the sheave and gripper blocks disposed upon the chain may be provided in some cases. The powered sheave assembly may further include multiple rollers disposed adjacent the conveyance apparatus and the sheave. In some cases, the conveyance apparatus may be wrapped on the powered sheave in its entirely, while in others, a majority of the conveyance apparatus is spooled on a separate reel. The powered sheave assembly may also include further a pair of powered rollers disposed adjacent the sheave.

In some other embodiments, methods for deploying a downhole tool into a wellbore with a conveyance apparatus include mounting a tool to a distal end of a spooled conveyance apparatus, where the conveyance apparatus is attached to the spool at a proximal end, and routing the conveyance apparatus around a powered sheave assembly having a sheave with a plurality of grooves disposed on the outer surface to accommodate the conveyance apparatus. The spool, the conveyance apparatus and the tool form a contiguous system. In some cases, a deployment bar is placed between the tool and conveyance apparatus. The powered sheave assembly may be attached to a pivotable mount and driven by a drive mechanism, and may further include multiple rollers disposed adjacent the conveyance apparatus and the sheave. A chain for driving the sheave may be provided with gripper blocks disposed upon the chain. The powered sheave assembly may further include a pair of powered rollers disposed adjacent the sheave. The conveyance apparatus may be routed through a sealing apparatus, a blowout preventer, and a wellhead, after being routed around the powered sheave, and then deployed into the wellbore by the powered sheave assembly. During deployment, the weight of the conveyance apparatus and tools or the like attached thereto is supported by a torque or power applied to the powered sheave.

In yet other embodiments, systems include a tool mounted to a distal end of a spooled conveyance apparatus, a powered sheave assembly having a plurality of grooves disposed on the outer surface of a sheave to accommodate the conveyance apparatus as routed there around, a sealing apparatus, a blowout preventer, and a wellhead attached to a wellbore, through which the conveyance apparatus pass through after the conveyance apparatus routed around a powered sheave. In an embodiment, the grooves disposed on the outer surface of the sheave comprise a substantially continuous helical groove to accommodate the conveyance apparatus as routed there around. The conveyance apparatus is deployable into the wellbore by the powered sheave assembly. The sealing apparatus may include a conical guide disposed upon a first end of the sealing apparatus and adjacent the sheave, and a gap defined between the conical guide and the outer surface of the sheave. In some cases, each groove is alignable with the conical guide.

Other embodiments include systems having a tool mounted to a distal end of a spooled conveyance apparatus, a powered sheave assembly with a sheave having a plurality of grooves disposed on the outer surface to accommodate the conveyance apparatus routed there around, a sealing apparatus, a blowout preventer, and a wellhead attached to a wellbore, through which the conveyance apparatus pass through after the conveyance apparatus is routed around a powered sheave. The powered sheave assembly deploys the conveyance apparatus into the wellbore, with force sufficient to move the conveyance apparatus both into and out of the wellbore. The conveyance apparatus may include surface features engageable by mating surface features disposed upon one or more of the powered sheave, rollers, and gripper blocks. Such systems may further include any or the components or features provided in the disclosure.

In some other aspects of the disclosure, systems include a tool mounted to a distal end of a spooled conveyance apparatus, which is also routed around a sheave, a sealing apparatus, a blowout preventer, and a wellhead attached to a wellbore, through which the conveyance apparatus pass through after the conveyance apparatus is routed around a powered sheave. The conveyance apparatus is deployable into the wellbore by the sheave assembly which provides a non-zero pushing force. In some cases, the non-zero pushing force is equal to or greater than the combined highest rated pressure in the wellbore and frictional force of the sealing apparatus. Such systems may further include any or the components or features provided in the disclosure.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DESCRIPTION

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments of the present disclosure provide a powered sheave, similar to an overhead crane drum, which is used to run a short section of conveyance apparatus in and out of a wellbore for deployment purposes. The sheave may include a means of gripping the conveyance apparatus so that the conveyance is forced into the wellbore. Examples of conveyance apparatus include, but are not necessarily limited to wireline cable, slickline cable, or plasticized wireline cable, capillary tubing, fiber composite tubing, coiled tubing, spring wire, and the like. The conveyance apparatus may be any type useful for conveyance of tools. Embodiments of the conveyance apparatus may comprise a length that is much shorter than the length of the wellbore, such as about 100 feet in overall length or the like.

Figure 1A:
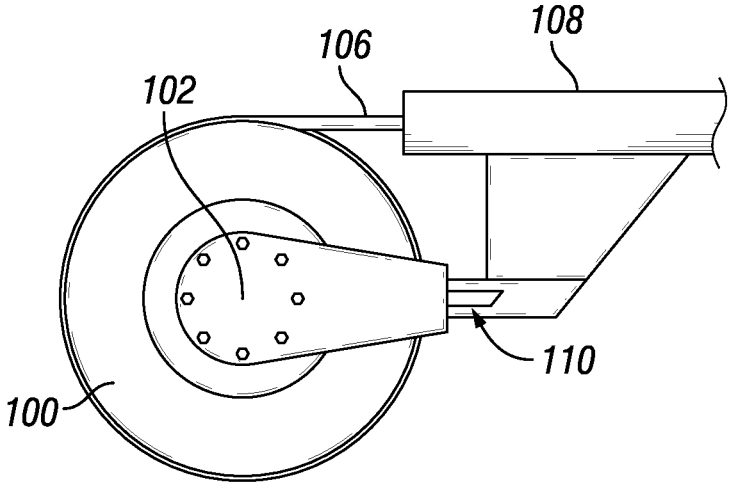
FIGS. 1A-1C illustrate in an isometric view, an embodiment in accordance with the disclosure.

Referring to FIGS. 1A through 10, together an isometric view of an embodiment in accordance with the disclosure, a powered sheave 100 is attached to mount 102 (FIG. 1A). A suitable drive mechanism (not shown) is provided between the sheave 100 and the mount 102 that rotates sheave 100. The outer diameter of the powered sheave 100 may be provided with grooves 104 matching the diameter of the wire or cable 106 (as shown in FIG. 10). A short exposed section of the wire 106 leads from the sheave 100 into the sealing apparatus 108 (FIG. 1*a*). Sheave mount 102 is arranged on pivot point 110 (depicted in FIG. 1B) such that the sheave 100 may swing allowing the grooves 106 successively align with the sealing mechanism 108. Pivot point 110 enables the outer periphery of sheave 100 to sweep along arc 112 such that the position of wire grooves may adjust in the event any misalignment exists between the centerline of the wire or cable 106 and the centerline of the sealing mechanism 108 (FIG. 10). Ideally two points on the arc 112 are chosen to match the centerline of the sealing mechanism 108, and the other parameters are adjusted so that the maximum positive and negative errors are equivalent. A simple roller (not shown) may be provided to keep the wire 106 from flopping around loose, similar to those seen on some typically used winches.

Figure 1B:
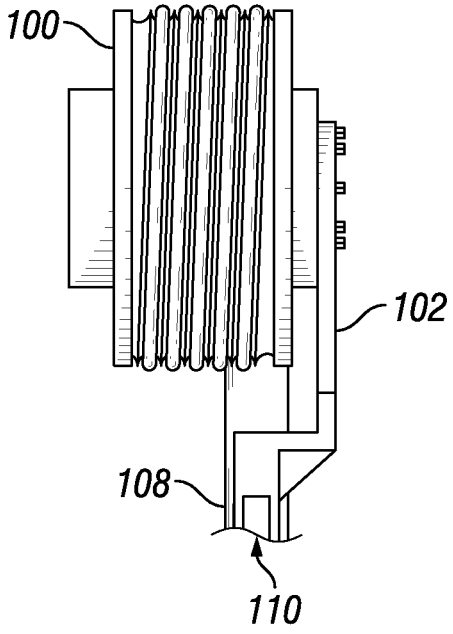
Figure 1C:
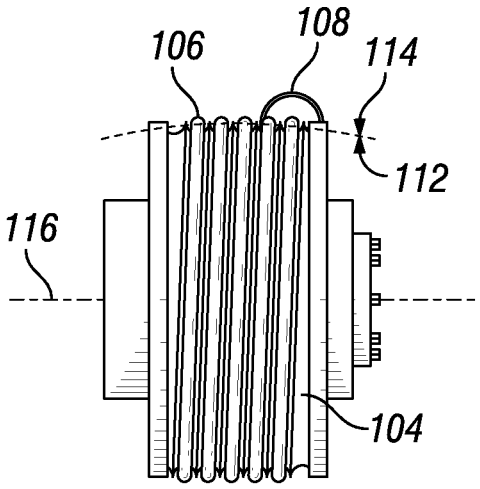
Figure 2:
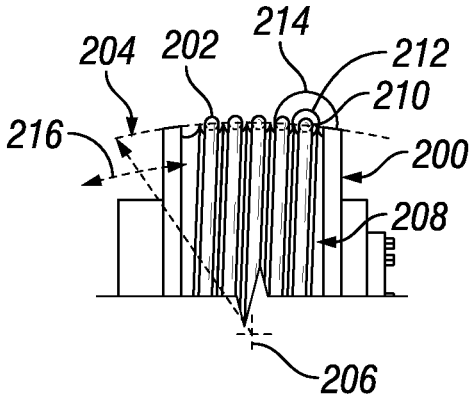
FIG. 2 shows a sheave embodiment in which the wireline centerlines are disposed on a swing circle according to the disclosure.

In an embodiment shown in FIG. 2, a modification to a sheave 200, which may be similar or same as sheave 100 illustrated in FIGS. 1A-10, is depicted in which the wireline centerlines 202 are disposed on a swing arc 204, and sheave 200 is pivotably disposed around axis 206. Axis 206 is positioned perpendicular to the plane that swing arc 204 lies upon. The grooves 208 are thus cut on the surface of a crowned sheave so that alignment between the wire 210 and opening 212 in sealing means 214 is essentially aligned across the range of the swing arc 204, in the directions indicated by arrow 216.

Figure 3:
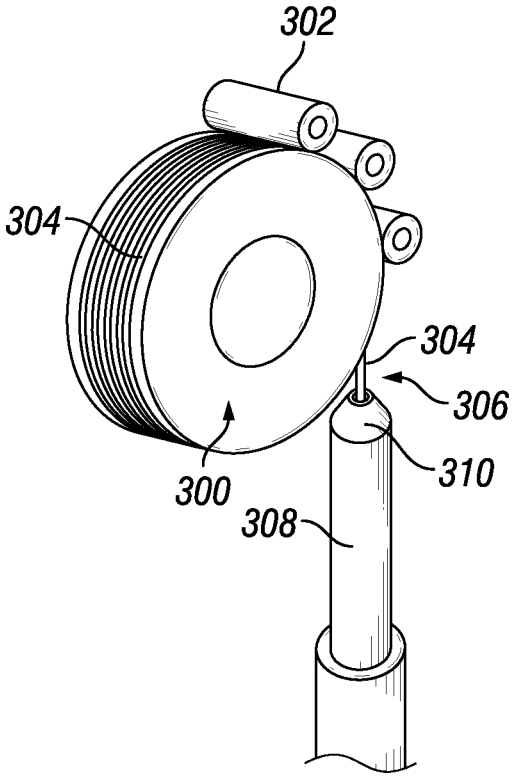
FIG. 3 depicts a sheave embodiment with multiple rollers clamped against the surface of the sheave in accordance with another aspect of the disclosure.

In an embodiment as shown in FIG. 3, multiple rollers 302 (three shown) are clamped against the surface of the sheave 300, which may be similar or same as sheaves 100 and 200 discussed above, so that wire 304 is constrained to move without any relative motion between it and the surface of the sheave 300. With rollers 302, the wire 304 may be pushed across a gap 306 formed between outer edge of sheave 300 and sealing means 308. The sealing means 308 may be provided with an extended conical guide 310 to minimize the exposed buckling length of gap 306. Because the forces required to overcome pressure are small (relative to the breaking strength of the wire), relatively little clamping load is required to achieve this. The rollers 302 are configured so that their contact does not deform the wire 304. The rollers 302 may be provided with grooves that match the sheave 300, and means to allow theses grooves to stay in alignment with the grooves on the sheave 300 as sheave 300 rotates. Rollers 302 may also be arranged to only contact the wire or conveyance means 304 that is about to enter the well, rather than all of or a portion of the multiple wraps, to minimize the total force that needs to be applied radially to the roller(s) 302, while providing sufficient alignment between rollers 302, conveyance means 304 and sealing means 308. In a nonlimiting example, with 10,000 psi of wellhead pressure on a 0.35" diameter cable with 300 pounds of seal friction, almost 1300 pounds of pushing force is required. With a coefficient of friction of 0.1, this means that a total interface force of 13,000 pounds is required to generate this push. With six rollers 302, only 2000 pounds of pressure per roller 302 is required. The pressure per roller 302 could be reduced (such as by half or the like) if the rollers 302 were powered and/or mechanically synchronized with the sheave 300. Such synchronization may also be provided by having the rollers 302 pressed against multiple turns of the conveyance means 304, thus forcing the rollers to turn at the same surface speed as the conveyance means 304, even if there is slippage between the last turn and a given roller 304. Also, if the sheave 300 or rollers 302 were provided with a high-friction surface, this force could also be significantly reduced. If the conveyance means 304 is provided with a textured surface (such as grooves), these may be engaged advantageously by features in the sheave 300 and/or rollers 302 to significantly reduce the clamping force required at the cost of additional complexity in sealing on the textured conveyance means 304.

Figure 4:
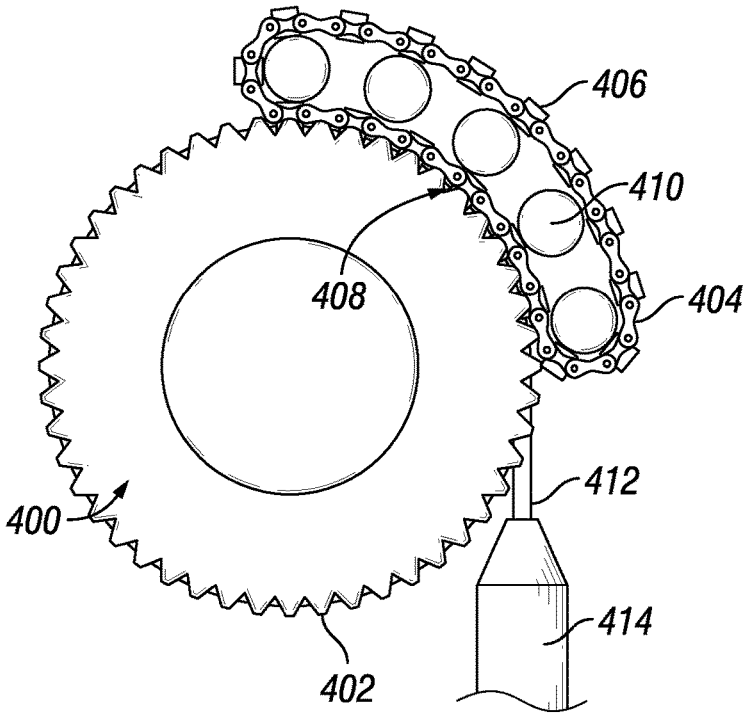
FIG. 4 illustrates a sheave embodiment having a toothed rim that engages a chain according to the disclosure.

Referring now to FIG. 4, there is shown an embodiment of a sheave 400, which may be similar or same as sheaves 100, 200 and 300 discussed above, and is provided with a toothed rim 402 that engages a chain 404. The chain 404 may be provided with gripper blocks 406 disposed on an outer side of links of chain 404 that press against the wire (not shown in FIG. 4 but similar to the wires 106, 304 of embodiments discussed above) at an interface 408. The rollers 410 are used to clamp the chain 404 against the sheave 400, and in an embodiment, the chain 404 could be roller backed and clamped in place with a beam or the like, which are similar to coiled tubing injectors. An exposed length 412 of the wire leads out of the traction zone and into the sealing means 414. The gripper blocks 406 may be shaped to match the outer profile of sheave 400, advantageously minimizing the stress concentration on the wire or cable and providing a large contact area. Further, synchronization between the sheave 400 and the gripper block 406 may be provided by the chain. In some cases, drive force may be provided by any suitable device other than the sheave rim.

Figure 5:
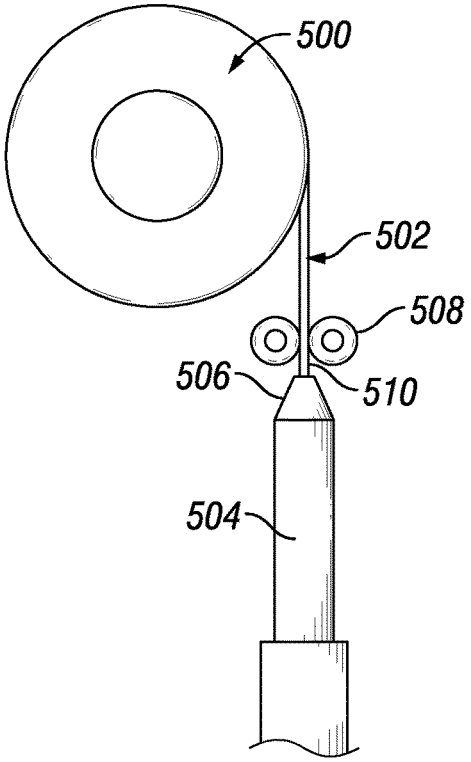
FIG. 5 shows an embodiment having a sheave, a sealing mechanism with an inlet conical guide, rollers and an exposed zone or gap, in accordance with another aspect of the disclosure.

In an embodiment shown in FIG. 5, there is shown a sheave 500, like or similar to any described above, with an exposed zone or gap 502 that is separated from the sealing mechanism 504 and an inlet conical guide 506 by rollers 508. The resulting exposed length 510 is shorter due to the small radii of rollers 508. Rollers 508 may driven and provided with grooved surfaces to match the wire or cable. A significant gripping force may be required in this embodiment, but the embodiment is mechanically simple. The rollers 508 may advantageously be air filled tires, rubber, or the like to maximize the contact and minimize stress concentrations.

The wire pushing rollers such as, but not limited to, the rollers 508, may have a groove formed with a radius configured to minimize the contact stresses or, in an embodiment, the rollers may be 'V' grooved, which would double the number of contact points. The sides of the 'V' groove should also have a radius to minimize contact stresses, such grooves are known as gothic arch grooves. A much steeper groove is desirable in the disclosed embodiments, in that it reduces the overall clamping force. A 60 degree 'V' angle may be desirable as the two side contact forces are substantially equal in magnitude to the clamping force. Such contact forces are designed such that neither the rollers nor the conveyance means are permanently deformed. In an aspect, this may be achieved by selecting a low elastic modulus material (relative to the conveyance means 502) for the rollers 508, which lowers the contact stresses considerably relative to the situation where the two elastic moduli are similar.

Figure 6:
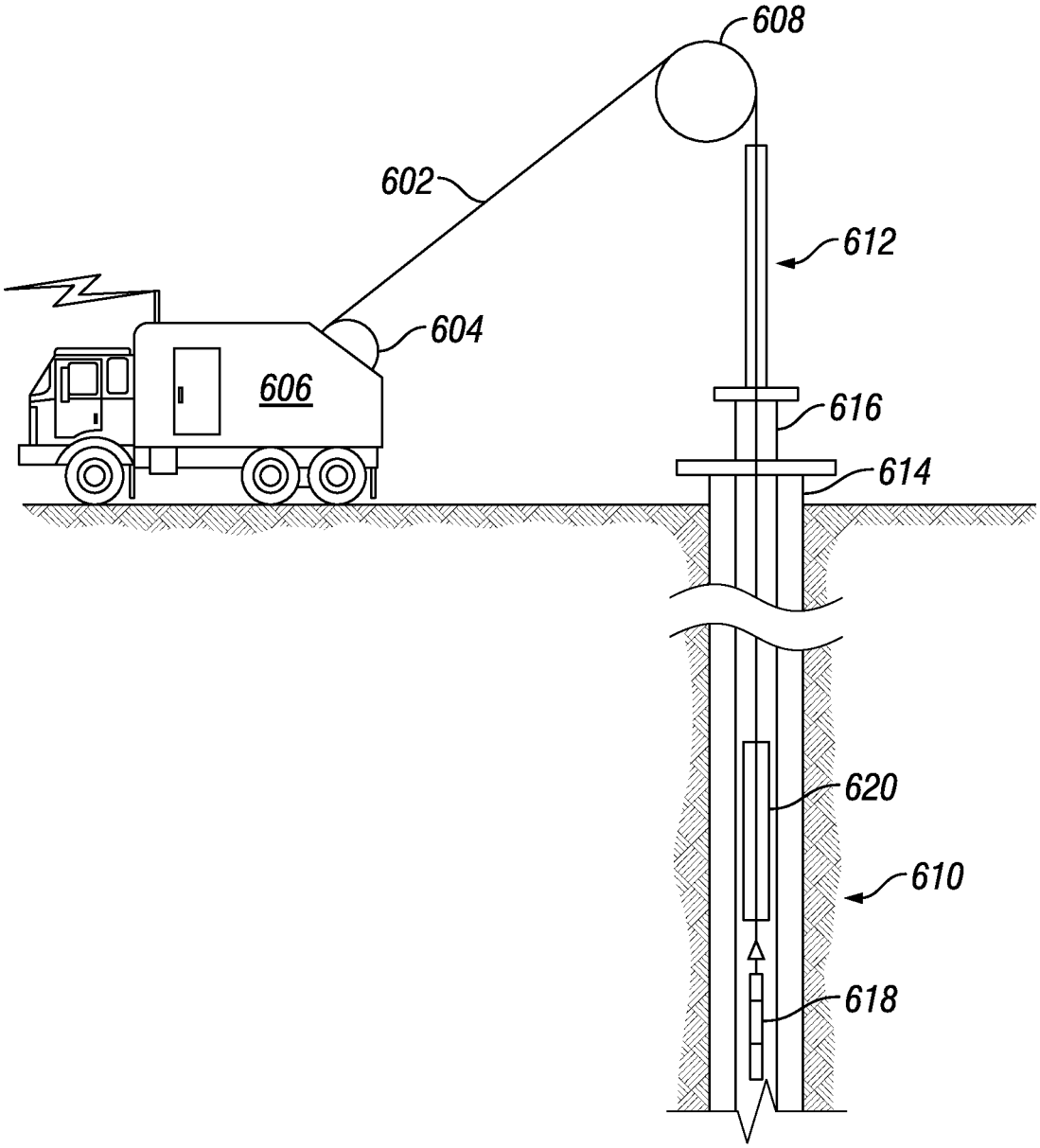
FIG. 6 depicts a typical use and deployment for wireline in a general sense; and, FIG. 7 depicts some method and system embodiments according to the disclosure.

Referring now to FIG. 6, illustrated is a typical use and deployment for wireline in a general sense, where a wireline 602 is spooled or coiled on a drum or reel 604 that is mounted on a wireline truck 606. The wireline 602 is unwound from the drum 604 and, after passing over sheave 608, is lowered into a wellbore 610 penetrating a subterranean formation. The wireline 602 passes over sheave 608 and then through a riser 612 which may include a lubricator to help seal the wellbore from the environment, then into blow out preventer 614, wellhead 616 and wellbore 610. One or more tools 618 are disposed on a distal end of the wireline 602 for performing a downhole operation. In some typical uses, a sinker bar 620 is disposed within the and/or around wireline 602 between tool 618 and drum 604, to add additional weight in to move the tools into the wellbore, where the wellhead pressure is significant and the tools are relatively light. Use of a long riser 612 is required to accommodate the tool(s) 618 and sinker bar, and the tool(s) 618 and sinker bar 620 are either pulled into the bottom of riser 612, or are assembled within riser 612.

Figure 7:
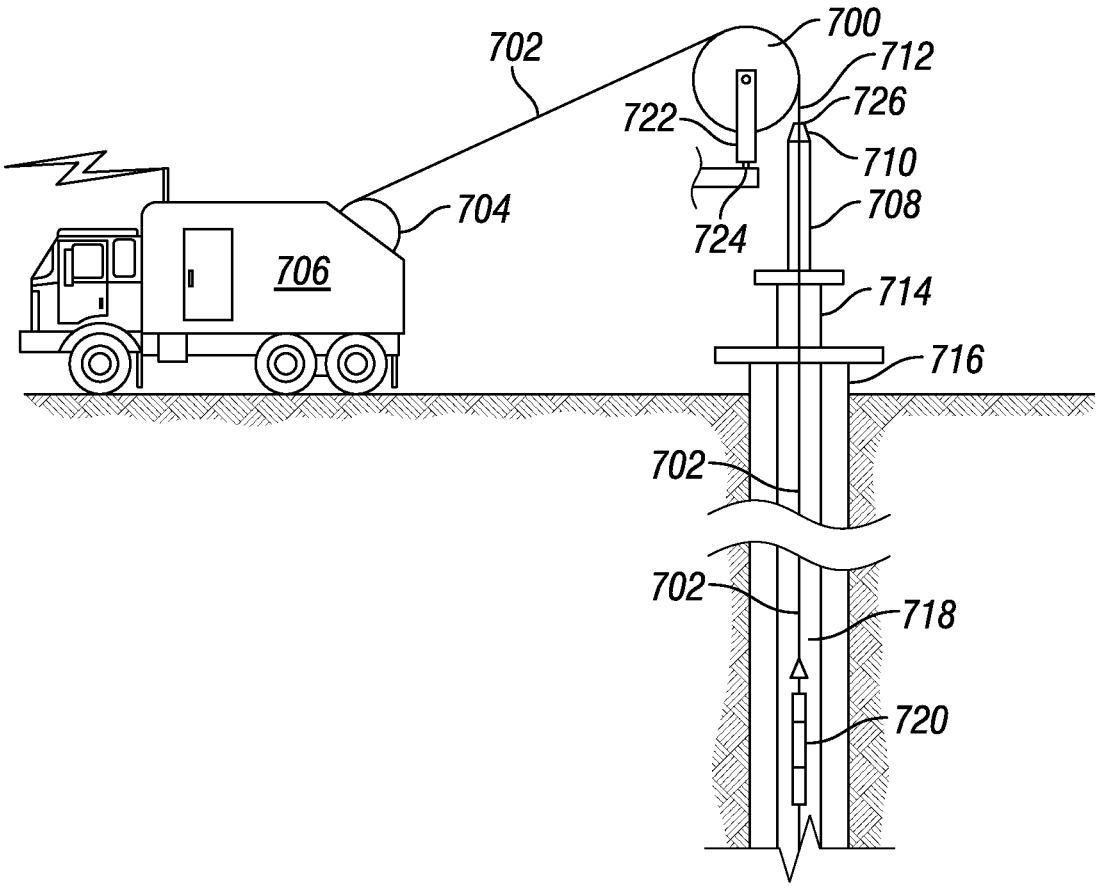

With reference to FIG. 7, an embodiment, according to the disclosure, is shown where a sheave 700, like or similar to any of 100, 200, 300, 400 or 500 discussed above, guides and applies force to a wireline, slickline or other suitable conveyance apparatus, 702. In FIG. 7 a wireline cable, 702 is shown to illustrate the embodiment, but the conveyance apparatus is not necessarily limited thereto. Wireline 702 is spooled or coiled on a drum or reel 704 mounted on a wireline truck 706. The wireline 702 passes over sheave 700 and through sealing apparatus 708, which may include a conical guide 710 to minimize any exposed buckling wireline length in gap 712 defined between edge of sheave 700 and sealing apparatus 708. Wireline 702 passes through blow out preventer 714, wellhead 716 and into wellbore 718. In some cases one end of the wireline 702 connected to drum 704, and the other distal end directly connected with tool 720, otherwise contiguously, with nothing disposed there between. In such cases, sheave 700 applies at least sufficient force to cable 702 to deploy and convey tool 720 into the wellbore 718 without use of other force applying apparatus, such as a sink bar attached to the wireline cable 702 prior to the tool 720. In some cases, the spool, the wireline cable and the tool form a contiguous system, without any use of a sinker bar attached to the wireline cable. The sheave 700 may be provided with various guides and/or gripping means as shown in FIGS. 1-5.

In some aspects, sheave 700 may be attached on a mount 722, which is attached to pivot point 724 (like or similar to that depicted in FIG. 1B). Use of the pivotable mount 722 allows sheave 700 to move freely in circular fashion to enable grooves on the outer surface of sheave 700 to precisely align with the sealing apparatus 708. In such cases, the plurality of grooves disposed on the outer surface of sheave 700 may be arranged in a swing circle so wire 706 and opening 726 in sealing apparatus 708 are alignable.

Sheaves useful in embodiments of the disclosure provide force to the conveyance apparatus, and may be powered by any suitable technique and/or device, including but not limited to power sources such as electric, natural gas, hydraulic, combustible engine, diesel engine, and the like. Power may be transferred to the sheave by direct drive, chain drive, hydraulic line, belt drive, and the like. Force exerted on the conveyance apparatus may be such force adequate to deploy and convey the tool(s) into the wellbore without causing damage to any of the apparatus.

In accordance with the disclosure, any useful number of grooves on the outer surface of the sheave may be used. In some aspects, a plurality of grooves are used, and the conveyance apparatus wraps around the sheave at least once, and in some cases, the conveyance apparatus completely wraps around the sheave one less time than the number of grooves disposed on the sheave. In some other aspects, the conveyance apparatus wraps around the sheave only a number of times sufficient to optimize requisite power input to the sheave with sufficient gripping force of the conveyance apparatus on the sheave, such that slippage is minimized or prevented.

Where a gap is defined between the outer surface of the sheave and the sealing apparatus, without or without a conical guide, the length of gap defined may be any suitable size that minimizes or prevents buckling, kinking, binding, slacking, or any other nonlinear orientation of the conveyance apparatus when passing from the sheave into the sealing apparatus. In some aspects, the length of the gap is about equal to or less than the diameter or longest cross-sectional dimension of the conveyance apparatus, while in other cases, the length of the gap is about equal to or greater than such dimension. In some embodiments, length of the gap is about from one to about five times the diameter or longest cross-sectional dimension of the conveyance apparatus. In some aspects, the gap length may be varied in operation to minimize any nonlinear orientation of the conveyance apparatus.

In some embodiments, a traction device is disposed between a powered sheave and the wellbore to provide axial force in both directions along the longitudinal axis of the conveyance device. Such traction device provides the ability to push or pull the conveyance device relative the wellbore. Since forces such as wellbore pressure with area forces act on the conveyance device to force it out of the wellbore, the weight of tools and a sinker bar act to pull the conveyance device into the hole, frictional forces in a pack off act to prevent motion in either direction, the end result in some cases is the need for axial force to push, pull, or otherwise control the conveyance device while being moved into, or out of the hole. In some instances, the axial force required is equivalent wellbore pressure multiplied by conveyance device outer area, plus friction force (i.e. about 100 pounds) less the tool string weight, and may allow introducing the conveyance device into the wellbore against the maximum pressure and maximum friction. Such approach may avoid use of equivalent sinker bar weight force, thereby increasing pulling capacity. Further, pushing with a traction device avoids high sinker bar lengths, or even the use of a sinker bar. In a non-limiting example, the axial force (a tensile force, which may be applied in opposite axial directions, i.e. a push force and a pull force) provided by embodiments of the powered sheave assembly disclosed herein to the conveyance device may be about fifty percent (50%) of the yield strength of the conveyance device. In operation, the magnitude of the pushing force exerted by the powered sheave assembly may be controlled such that the pushing force is less than a buckling load of an exposed length of the conveyance device, such as area 106 shown in FIG. 1A.

Embodiments according to the disclosure may be useful in cased hole and/or open hole operations, which include the use of coiled tubing, wireline or slickline conveyance apparatus. In some open hole wireline operations, during the drilling of wells measurements are performed to collect information regarding formations penetrated by well-bore. In such wireline operations, a wireline truck couples to a wireline tool via an armored wireline cable that includes a conduit for conducting communication signals and power signals. Armored cable serves both to physically couple the wireline tool to the wireline truck and to allow electronics contained within the wireline truck to communicate with the wireline tool. Some examples of measurements taken during wireline operations include formation resistivity (or conductivity) logs, natural radiation logs, electrical potential logs, density logs (gamma ray and neutron), micro-resistivity logs, electromagnetic propagation logs, diameter logs, formation tests, formation sampling and other measurements. Some useful systems for conducting wireline operations include those disclosed in U.S. Pat. No. 6,691,779, which is incorporated herein in its entirety by reference.

Some cased-hole wireline operations include logging which involves retrieving logging measurements through the well casing, or the metal piping that is inserted into the well during completion operations. Cased-hole logging may be used to help operators obtain additional information from a well or reservoir that has already been completed. For example, the well may have already started production and a cased-hole log could help determine what has hampered flow. In some cases, the decision must be made to plug and abandon the well or recomplete it, and the cased-hole log will help identify what lies beyond the casing of the well. Cased-hole logging can be used to evaluate the formation and completion of the well, as well as determine the state of the cement, corrosion and perforation. Both gamma ray and neutron porosity logs can be run through the casing of a well, and better ideas of thermal decay and interval transit time can be achieved through porosity, hydrocarbon saturation and producibility measurements.

While a wireline truck and wireline cable are depicted in embodiments illustrated above, it is within the scope and spirit of the disclosure to apply systems and methods for coiled tubing and slickline operations as well. In coiled tubing operations, a coiled tubing rig is provided which transports and contains coiled tubing on one or more reels. Similar to or like those illustrations above, coiled tubing is deployed around the powered sheave and through a sealing apparatus, which may include a conical guide. The tubing passes through a blow out preventer, wellhead and into the wellbore. In some cases one end of the coiled tubing is to the reel, and other distal end directly connected with a tool, often called a bottom hole assembly (BHA), with nothing disposed there between. The sheave applies at least sufficient force to deploy and convey the coiled tubing and tool into the wellbore, without use of other force applying apparatus. Tools used in coiled tubing operations include, but are not limited to a jetting nozzle, for jobs involving pumping chemicals, stimulation fluid, drilling fluid or cement through the coiled tubing, drilling tools, perforation tools, large strings of logging tools, and the like, depending on the operations.

While certain wireline and coiled tubing operations are discussed above, embodiments of the disclosure may be applicable to any type of wireline, slickline and coiled tubing operations useful in exploration, development and production of petroleum products.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for deploying a downhole tool into a wellbore with a conveyance apparatus, the method comprising:

mounting a tool to a distal end of a spooled conveyance apparatus;

routing the conveyance apparatus around a powered sheave assembly comprising a sheave, wherein the sheave comprises a plurality of grooves disposed on an outer surface thereof and extending generally in line with the conveyance apparatus to accommodate the conveyance apparatus;

providing a power source for applying torque to the powered sheave; and providing a pushing force to the conveyance apparatus with the powered sheave assembly to deploy the conveyance apparatus and tool into the wellbore, the sheave being attached to a mount which is arranged on a pivot such that the sheave may sweep along a defined arc oriented such that each groove of the plurality of grooves is allowed to align with a fixed location so as to facilitate deployment of the conveyance apparatus down into the wellbore.

2. The method of claim 1 further comprising mounting the tool to a deployment bar.

3. The method of claim 1 wherein a traction device is disposed between the powered sheave and the wellbore to provide axial force in both directions.

4. The method of claim 1 where the powered sheave comprises gripping means which assist in application of force upon the conveyance apparatus to overcome pressure and friction resistance.

5. The method of claim 1 wherein the powered sheave assembly further comprises multiple rollers disposed adjacent the conveyance apparatus and the sheave.

6. The method of claim 1 wherein the conveyance apparatus may be wrapped on the powered sheave in its entirely.

7. The method of claim 1 wherein a majority of the conveyance apparatus is spooled on a separate reel.

8. The method of claim 1 wherein the powered sheave assembly further comprises a chain and gripper blocks disposed upon the chain for providing synchronization between the sheave and the chain.

9. The method of claim 1 wherein the powered sheave assembly further comprises a pair of powered rollers disposed adjacent the sheave.

10. The method of claim 1 wherein the conveyance apparatus is a wireline cable or a slickline.

11. The method of claim 1 wherein the grooves comprise a substantially helical groove disposed on the outer surface of the powered sheave assembly.

12. The method of claim 1 wherein the downhole tool is deployed into a wellbore in advance of coiled tubing.

13. The method of claim 1 further comprising routing the conveyance apparatus through a sealing apparatus, a blowout preventer, and a wellhead, after the routing the conveyance apparatus around the sheave.

14. The method of claim 13 wherein the sealing apparatus comprises a conical guide disposed upon a first end of the sealing apparatus and adjacent the sheave, and wherein a gap is defined between the conical guide and the outer surface of the sheave.

15. The method of claim 1 wherein a length of the conveyance apparatus is about 100 feet.

16. A method for deploying a downhole tool into a wellbore with a conveyance apparatus, the method comprising:

mounting a tool to a distal end of a section of a spooled conveyance apparatus, wherein the conveyance apparatus is attached to a spool at a proximal end;

routing the conveyance apparatus around a powered sheave assembly comprising a sheave, wherein the sheave comprises a substantially helical groove disposed on the outer surface, the helical groove being sized to accommodate the conveyance apparatus therein during rotation of the sheave;

providing a pushing force to the conveyance apparatus with the powered sheave assembly to move the conveyance apparatus through a sealing apparatus and to deploy the conveyance apparatus and tool into the wellbore, wherein the spool, the conveyance apparatus and the tool form a contiguous system; and allowing the sheave to pivot along an arc oriented transversely to the direction of travel of the conveyance apparatus, the arc being sized to maintain alignment between a centerline of the conveyance apparatus and a centerline of the sealing apparatus as the conveyance apparatus is deployed from any of a plurality of positions along the helical groove of the sheave.

17. The method of claim 16 further comprising mounting the tool to a deployment bar.

18. The method of claim 16 wherein the powered sheave assembly is attached to a pivotable mount and wherein the powered sheave is driven by a drive mechanism.

19. The method of claim 16 wherein the powered sheave assembly further comprises multiple rollers disposed adjacent the conveyance apparatus and the sheave.

20. The method of claim 16 wherein the powered sheave assembly further comprises a chain for driving the sheave and gripper blocks disposed upon the chain.

21. The method of claim 16 wherein the powered sheave assembly further comprises a pair of powered rollers disposed adjacent the sheave.

22. The method of claim 16 wherein the conveyance apparatus is a wireline cable.

23. The method of claim 16 wherein the conveyance apparatus is a slickline.

24. The method of claim 16 wherein the downhole tool is deployed into a wellbore in advance of coiled tubing.

25. The method of claim 16 further comprising routing the conveyance apparatus through a blowout preventer and a wellhead, after the routing the conveyance apparatus around the sheave.

26. The method of claim 25 wherein the sealing apparatus comprises a conical guide disposed upon a first end of the sealing apparatus and adjacent the sheave, and wherein a gap is defined between the conical guide and the outer surface of the sheave.

27. The method of claim 26 wherein each groove comprised in the plurality of grooves is alignable with the conical guide.

28. The method of claim 16 wherein the conveyance apparatus is deployed into the wellbore by the powered sheave assembly.

29. A system comprising:

a tool mounted to a distal end of a spooled conveyance apparatus;

a powered sheave assembly comprising a sheave, wherein the sheave comprises a plurality of grooves disposed circumferentially along the outer surface to accommodate the conveyance apparatus therein during rotation of the sheave, and wherein the conveyance apparatus is routed around the sheave, the sheave being attached to a mount which is arranged on a fixed pivot such that the sheave may swing transversely to a direction of travel of the conveyance apparatus to thus allow the plurality of grooves to better align for accommodating deployment of the spooled conveyance apparatus;

a sealing apparatus, a blowout preventer, and a wellhead, through which the conveyance apparatus passes through after the conveyance apparatus is routed around the sheave; and, a wellbore;

wherein the conveyance apparatus and the tool is deployable into the wellbore by providing a pushing force to the conveyance apparatus with the powered sheave assembly.

30. The apparatus of claim 29 wherein the sealing apparatus comprises a conical guide disposed upon a first end of the sealing apparatus and adjacent the sheave, and wherein a gap is defined between the conical guide and the outer surface of the sheave.

31. The apparatus of claim 30 wherein each groove comprised in the plurality of grooves is alignable with the conical guide.

32. The apparatus of claim 29 wherein the conveyance apparatus is a wireline cable or a slickline.

33. A system comprising:

a tool mounted to a distal end of a spooled conveyance apparatus;

a powered sheave assembly comprising a sheave, wherein the sheave comprises a plurality of grooves disposed on the outer surface to accommodate the conveyance apparatus, and wherein the conveyance apparatus is routed around the sheave;

a sealing apparatus, a blowout preventer, and a wellhead, through which the conveyance apparatus pass through after the conveyance apparatus is routed around a powered sheave; and a wellbore;

wherein the conveyance apparatus is deployable into the wellbore by the powered sheave assembly, and wherein the powered sheave assembly provides a pushing force to convey the tool and the conveyance apparatus into and out of the wellbore, the sheave being pivotably mounted to a fixed pivot which maintains movement of the sheave along an arc oriented generally transverse to the plurality of grooves, the arc being sized such that pivoting movement of the sheave maintains alignment between a centerline of the spooled conveyance apparatus and a centerline of the sealing apparatus as the spooled conveyance apparatus is deployed from the sheave and into the sealing apparatus.

34. The system of claim 33 wherein the conveyance apparatus comprises surface features engageable by mating surface features disposed upon one or more of the powered sheave, rollers, and gripper blocks.

35. A system comprising:

a tool mounted to a distal end of a spooled conveyance apparatus;

a powered sheave assembly comprising a circular sheave, wherein the conveyance apparatus is routed around the circular sheave, the circular sheave being attached to a mount which is arranged on a fixed pivot about which the circular sheave is able to pivot along a defined arc oriented generally transversely to a direction of travel of the conveyance apparatus;

a sealing apparatus, a blowout preventer, and a wellhead, which remain stationary while the conveyance apparatus passes therethrough after the conveyance apparatus is routed around the circular sheave, the fixed pivot allowing the circular sheave to swing so as to help align a centerline of the conveyance apparatus with the sealing apparatus, as the sealing apparatus remains stationary, to thus facilitate entry of the conveyance apparatus into the sealing apparatus; and a wellbore;

wherein the conveyance apparatus and the tool are deployable into the wellbore by the powered sheave assembly providing a non-zero pushing force.

36. The system of claim 35 wherein the non-zero pushing force is equal to or greater than the combined highest rated pressure in the wellbore and frictional force of the sealing apparatus.

* * * * *